US012270552B2

(12) United States Patent
Cadima

(10) Patent No.: US 12,270,552 B2
(45) Date of Patent: Apr. 8, 2025

(54) GAS COOKTOP WITH GRIDDLE ASSEMBLY INCLUDING REMOVABLE TEMPERATURE PROBE

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 255 days.

(21) Appl. No.: 17/993,433

(22) Filed: Nov. 23, 2022

(65) Prior Publication Data

US 2024/0167689 A1 May 23, 2024

(51) Int. Cl.
*F24C 3/12* (2006.01)

(52) U.S. Cl.
CPC ..... *F24C 3/126* (2013.01)

(58) Field of Classification Search
CPC ..... F24C 3/126
USPC ..... 126/39 G; 374/100, 208
See application file for complete search history.

(56) References Cited

U.S. PATENT DOCUMENTS

| | | | |
|---|---|---|---|
| 5,413,032 | A | 5/1995 | Bruno et al. |
| 7,255,100 | B2 | 8/2007 | Repper et al. |
| 8,084,719 | B2 | 12/2011 | Ciancimino et al. |
| 9,562,686 | B2 | 2/2017 | Arenaza |
| 9,841,191 | B2 | 12/2017 | Johncock et al. |
| 10,485,379 | B2 | 11/2019 | Bennett et al. |
| 10,584,871 | B2 | 3/2020 | Biagioli et al. |
| 10,619,858 | B2 | 4/2020 | Paller |
| 10,660,473 | B2 | 5/2020 | Dahle et al. |
| 10,935,250 | B2 | 3/2021 | Andueza et al. |
| 11,015,813 | B2 | 5/2021 | Billman et al. |
| 11,109,709 | B2 | 9/2021 | Lee et al. |
| 2002/0073985 | A1 | 6/2002 | Leukhardt et al. |
| 2013/0305933 | A1 | 11/2013 | Heidrich et al. |
| 2018/0338644 | A1 | 11/2018 | Gossens et al. |
| 2019/0309954 | A1 | 10/2019 | Andueza et al. |
| 2020/0300507 | A1 | 9/2020 | Cowan et al. |
| 2020/0408413 | A1 | 12/2020 | Billman et al. |
| 2021/0148575 | A1 | 5/2021 | Cadima |
| 2021/0172607 | A1* | 6/2021 | Cadima ..... F24C 3/082 |
| 2021/0254834 | A1* | 8/2021 | Bhogal ..... G01K 1/14 |

(Continued)

FOREIGN PATENT DOCUMENTS

| | | | |
|---|---|---|---|
| CN | 201241956 | Y | 5/2009 |
| CN | 111692408 | A | 9/2020 |

(Continued)

*Primary Examiner* — Vivek K Shirsat
(74) *Attorney, Agent, or Firm* — Dority & Manning, P.A.

(57) ABSTRACT

A gas cooktop includes a gas burner for selectively generating a flow of heated air, a griddle defining a probe receptacle, a griddle magnet positioned within the probe receptacle, and a temperature sensor configured for receipt within the probe receptacle. The temperature sensor includes a sensor housing, a temperature probe positioned within the sensor housing and being movable between an extended position and a retracted position, and a probe magnet mounted to the sensor housing, the probe magnet engaging and utensil magnet to secure the temperature sensor such that the temperature probe engages the contact pin and is pushed into the retracted position.

20 Claims, 5 Drawing Sheets

(56) References Cited

U.S. PATENT DOCUMENTS

| | | | |
|---|---|---|---|
| 2021/0274968 | A1 | 9/2021 | Steiner et al. |
| 2022/0007889 | A1 | 1/2022 | Cadima |

FOREIGN PATENT DOCUMENTS

| | | | |
|---|---|---|---|
| EP | 2896329 | B1 | 12/2018 |
| ES | 2725174 | T3 | 9/2019 |
| JP | H10246424 | A | 9/1998 |
| JP | 2015062666 | A | 4/2015 |
| JP | 2022013345 | A | 1/2022 |
| WO | WO2020008088 | A2 | 1/2020 |

* cited by examiner

GAS COOKTOP WITH GRIDDLE ASSEMBLY INCLUDING REMOVABLE TEMPERATURE PROBE

FIELD OF THE INVENTION

The present subject matter relates generally to gas cooktops, and more particularly, to griddle assemblies including removable temperature probes for use in gas cooktops.

BACKGROUND OF THE INVENTION

Conventional gas cooktop appliances have one or more gas burners, e.g., positioned at a cooktop surface for use in heating or cooking an object, such as a cooking utensil and its contents. These gas burners typically combust a mixture of gaseous fuel and air to generate heat for cooking. These gas cooktops may include a grate or other support structure for receiving various cooking utensils, such as a griddle. For example, griddles may be positioned on the grate of the gas cooktop and may extend across multiple gas burners to provide a large, flat cooking surface.

Notably, it may frequently be desirable to facilitate a closed loop cooking cycle with removable cooking utensils such as a griddle, e.g., by monitoring the temperature of the griddle and adjusting the gas burners to maintain the desired griddle temperature. Accordingly, gas cooktop appliances having a griddle with automatic temperature control may include a temperature probe that is received within the griddle for providing temperature feedback. However, these griddles are not consumer removeable and the conventional temperature probes are fixed within or against the griddle, communicating temperature measurements to a remotely located controller. Even if such probes and temperature probes were removable, ensuring proper positioning of the temperature probe within the griddle may be difficult, potentially resulting in inaccurate temperature readings, failed communication with a supervisory controller, etc.

Notably, conventional temperature probes are long, sheathed probes that are either inserted into a bored hole in a side of a griddle, or fastened against a bottom surface. When fastened to a bottom surface, the sensor is not consumer accessible and such griddle assemblies are not removable for cleaning. For griddles that are consumer removable and have a side mounted probe, such a configuration would require precision drilling and results in increased manufacturing costs. In addition, to maintain a minimum wall thicknesses about the drilled hole, the griddle may need a thicker cross section of material, further driving up costs and resulting in material waste. Moreover, many types of pots and pans do not provide a sufficient thickness for accommodating such drilled holes.

Temperature probes may be secured in position using a pair of magnets. However, a user would frequently need to pull hard to overcome the magnetic force to remove the probe. While applying this force, users may unintentionally apply a lateral force on the probe, resulting in very high bending stresses, thus requiring a more robust, expensive probe construction to survive these stresses.

Accordingly, a gas cooktop including a user removable griddle with temperature measuring capabilities would be useful. More specifically, a temperature probe that may be used with a griddle and other cooking utensils on a gas cooktop and that ensures quick and secure installation and removal would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a gas cooktop defining a vertical direction, a lateral direction, and a transverse direction is provided. The gas cooktop includes a gas burner for selectively generating a flow of heated air, a cooking utensil defining a probe receptacle and a contact pin within the probe receptacle, a utensil magnet positioned within the probe receptacle, and a temperature sensor configured for receipt within the probe receptacle. The temperature sensor includes a sensor housing, a temperature probe positioned within the sensor housing and being movable between an extended position and a retracted position, and a probe magnet mounted to the sensor housing, the probe magnet engaging and utensil magnet to secure the temperature sensor such that the temperature probe engages the contact pin and is pushed into the retracted position.

In another exemplary embodiment, a cooking utensil assembly for a gas cooktop is provided. The gas cooktop includes a gas burner for selectively generating a flow of heated air and the cooking utensil assembly includes a cooking utensil defining a probe receptacle and a contact pin within the probe receptacle, a utensil magnet positioned within the probe receptacle, and a temperature sensor configured for receipt within the probe receptacle. The temperature sensor includes a sensor housing, a temperature probe positioned within the sensor housing and being movable between an extended position and a retracted position, and a probe magnet mounted to the sensor housing, the probe magnet engaging and utensil magnet to secure the temperature sensor such that the temperature probe engages the contact pin and is pushed into the retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
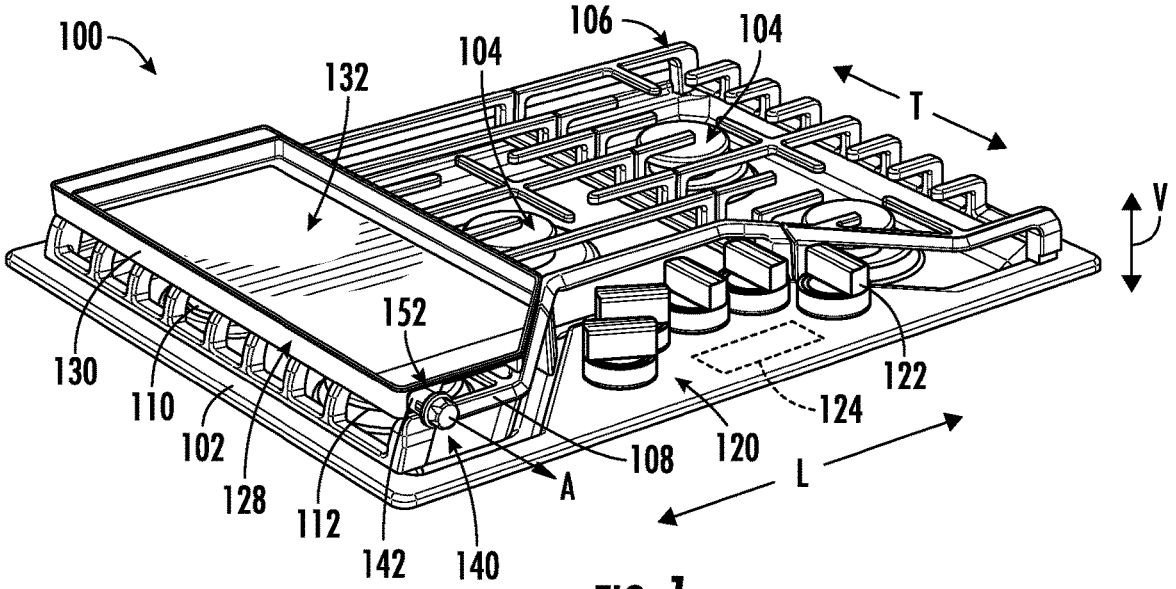
FIG. 1 provides a perspective view of a gas cooktop including a griddle assembly according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance, e.g., a gas cooktop 100, of the present disclosure. Gas cooktop 100 may be fitted integrally with a surface of a kitchen counter, may be configured as a slide-in cooktop unit, may be a part of a free-standing range cooking appliance, etc. Gas cooktop 100 may generally define a vertical direction V, a lateral direction L, and a transverse direction T, each of which is mutually perpendicular, such that an orthogonal coordinate system is generally defined. References to the horizontal direction or plane may refer generally to the plane defined by the lateral direction L and the transverse direction T.

Gas cooktop 100 includes a top panel 102 that includes one or more heating sources, such as heating elements 104 for use in, e.g., heating or cooking. Top panel 102, as used herein, refers to any upper surface of gas cooktop 100 over which utensils may be heated and therefore food cooked. In general, top panel 102 may be constructed of any suitably rigid and heat resistant material capable of supporting heating elements 104, cooking utensils, and/or other components of gas cooktop 100. By way of example, top panel 102 may be constructed of enameled steel, stainless steel, glass, ceramics, and combinations thereof.

According to the illustrated embodiment, the heating elements 104 of gas cooktop 100 are gas burners. However, although referred to as "gas cooktop" herein, it should be appreciated that aspects of the present subject matter may be applicable to other cooktop appliances, e.g., such as electrical resistance cooktops, inductive cooktops, etc. In addition, gas cooktop 100 may include one or more grates 106 configured to support a cooking utensil, such as a pot, pan, etc. In general, grates 106 include a plurality of elongated members 108, e.g., formed of cast metal, such as cast iron. The cooking utensil may be placed on the elongated members 108 of each grate 106 such that the cooking utensil rests on an upper surface of elongated members 108 during the cooking process. Heating elements 104 are positioned underneath the various grates 106 such that heating elements 104 provide thermal energy to cooking utensils above top panel 102 by combustion of fuel below the cooking utensils.

In some embodiments, the heating elements 104 of gas cooktop 100 may include a plurality of gas burners that are positioned on and/or within top panel 102 and have various sizes, as shown in FIG. 1, so as to provide for the receipt of cooking utensils (i.e., pots, pans, etc.) of various sizes and configurations and to provide different heat inputs for such cooking utensils. For example, the gas cooktop 100 may include a first gas burner 110 disposed on the top panel 102 and a second gas burner 112 spaced apart from the first gas burner 110 on the top panel 102. For example, as illustrated, the first gas burner 110 and the second gas burner 112 may be aligned along the transverse direction T. The top panel 102 may also include a recessed portion, e.g., which extends downward along the vertical direction V. The first gas burner 110 and the second gas burner 112 may be positioned within the recessed portion. The recessed portion may collect spilled material, e.g., foodstuffs, during operation of the gas cooktop 100.

In the illustrated example embodiments, each gas burner 110, 112 includes a generally circular shape from which a flame may be emitted. As shown, each gas burner 110, 112 includes a plurality of fuel ports defined circumferentially in fluid communication with an internal passage of each respective gas burner 110, 112. In some embodiments, one or both of the first gas burner 110 and the second gas burner 112 may be a multi-ring burner. For example, the first gas burner 110 may include a first plurality of fuel ports defining a first ring of the first gas burner 110 and a second plurality of fuel ports defining a second ring of the first gas burner 110. In such embodiments, a first fuel chamber in fluid communication with the first plurality of fuel ports may be separated from a second fuel chamber in fluid communication with the second plurality of fuel ports by a wall within the first gas burner 110, and fuel may be selectively supplied to one or both of the fuel chambers within first gas burner 110. In some embodiments of a cooktop appliance, multiple burners of differing types may be provided in combination, e.g., one or more single-ring burners as well as one or more multi-ring burners. Moreover, other suitable burner configurations are also possible.

According to the illustrated example embodiment, a user interface panel or control panel 120 is located within convenient reach of a user of gas cooktop 100. For this example embodiment, control panel 120 includes control knobs 122 that are each associated with one of heating elements 104. Control knobs 122 allow the user to activate each heating element 104 and regulate the amount of heat input each heating element 104 provides to a cooking utensil located thereon. Although gas cooktop 100 is illustrated as including control knobs 122 for controlling heating elements 104, it will be understood that control knobs 122 and the configuration of gas cooktop 100 shown in FIG. 1 is provided by way of example only. More specifically, control panel 120 may include various input components, such as one or more of a variety of touch-type controls, electrical, mechanical or electro-mechanical input devices including rotary dials, push buttons, and touch pads.

According to the illustrated embodiment, control knobs 122 are located within control panel 120 of gas cooktop 100. However, it should be appreciated that this location is used only for the purpose of explanation, and that other locations and configurations of control panel 120 and control knobs 122 are possible and within the scope of the present subject matter. Indeed, according to alternative embodiments, control knobs 122 may instead be located directly on top panel 102 or elsewhere on gas cooktop 100, e.g., on a backsplash, front bezel, or any other suitable surface of gas cooktop 100. Control panel 120 may also be provided with one or more graphical display devices, such as a digital or analog display device designed to provide operational feedback to a user.

Referring again to FIG. 1, operation of the gas cooktop 100 may be regulated by a controller 124 that is operably coupled to (i.e., in operative communication with) the user inputs (e.g., control knobs 122) and/or heating elements 104. In this regard, control panel 120, control knobs 122, and other suitable inputs/outputs may be in communication with controller 124 such that controller 124 may regulate operation of gas cooktop 100. For example, signals generated by controller 124 may operate gas cooktop 100, including any or all system components, subsystems, or interconnected devices, in response to the position of control knobs 122 and other control commands. Control panel 120 and other components of gas cooktop 100 may be in communication with controller 124 via, for example, one or more signal lines or shared communication busses. In this manner, Input/Output ("I/O") signals may be routed between controller 124 and various operational components of gas cooktop 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 124 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 124 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 124 may be operable to execute programming instructions or micro-control code associated with an operating cycle of gas cooktop 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 124 as disclosed herein is capable of and may be operable to perform any methods, method steps, or portions of methods as disclosed herein. For example, in some embodiments, methods disclosed herein may be embodied in programming instructions stored in the memory and executed by controller 124.

The memory devices may also store data that can be retrieved, manipulated, created, or stored by the one or more processors or portions of controller 124. The data can include, for instance, data to facilitate performance of methods described herein. The data can be stored locally (e.g., on controller 124) in one or more databases and/or may be split up so that the data is stored in multiple locations. In addition, or alternatively, the one or more database(s) can be connected to controller 124 through any suitable network(s), such as through a high bandwidth local area network (LAN) or wide area network (WAN). In this regard, for example, controller 124 may further include a communication module or interface that may be used to communicate with one or more other component(s) of gas cooktop 100, controller 124, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

As shown in FIGS. 1 through 6, gas cooktop 100 may further include a griddle assembly 128 that may be installed on gas cooktop 100 as a cooking utensil. In general, griddle assembly 128 may include a griddle 130 that it selectively disposed over (e.g., directly above) one or more spaced-apart heating elements 104. For example, according to the illustrated embodiment, griddle 130 is positioned over a pair of burners, e.g., first gas burner 110 and second gas burner 112 to define a single, flat cooking surface collectively heated by gas burners 110, 112.

Specifically, during use, a top surface 132 of griddle 130 (i.e., a cooking surface) faces away from top panel 102 to receive a cooking item (e.g., food) thereon. By contrast, a bottom surface 134 may be opposite from top surface 132 and faces top panel 102 during use. Thus, the bottom surface 134 may face top panel 102 to receive a thermal output (e.g., flame or heated air) from the corresponding burners 110, 112. Although the present disclosure discusses the use of griddle 130 as the cooking utensil for use with gas cooktop 100, it should be appreciated that aspects of the present subject matter may apply to the use of other cooking utensils as well, e.g., such as a skillet, a pot, a pan, etc.

Figure 3:
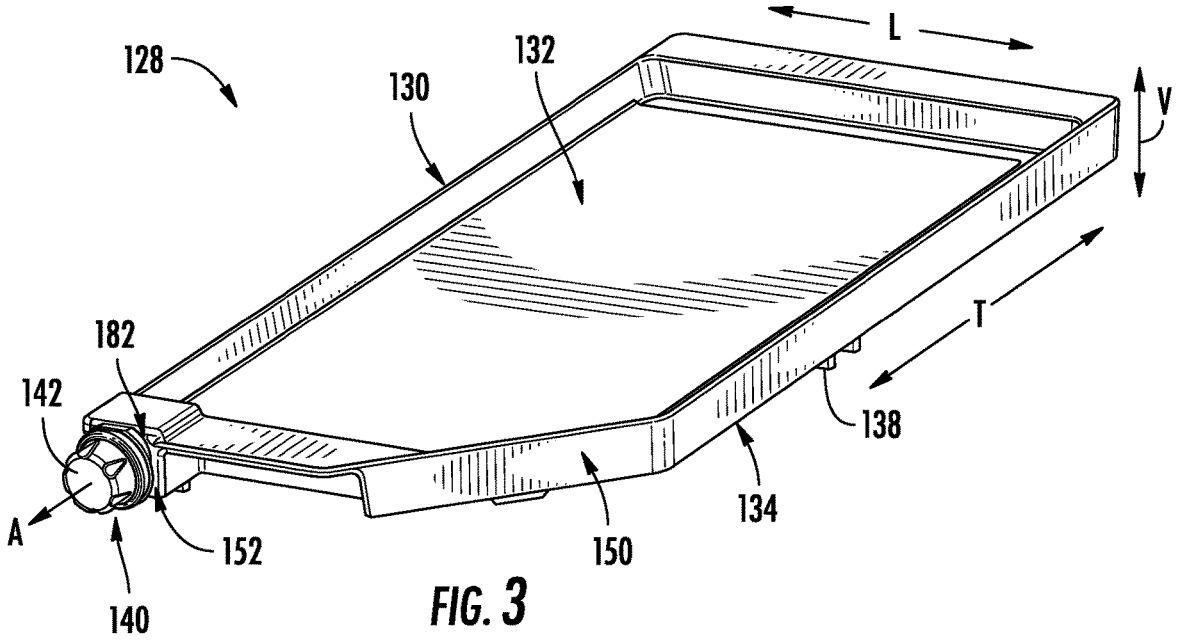
FIG. 3 provides a top, perspective view of a temperature sensor installed in the exemplary griddle assembly of FIG. 1 according to example embodiments of the present subject matter.
Figure 4:
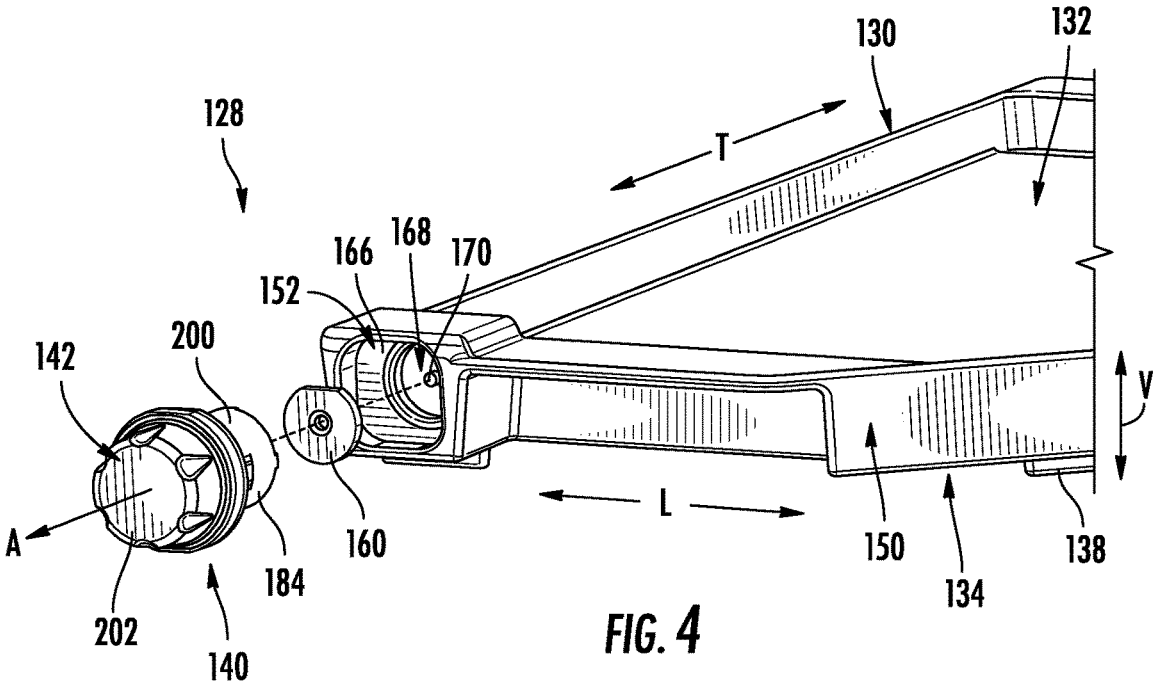
FIG. 4 provides a perspective view of the exemplary temperature sensor of FIG. 3 removed from the exemplary griddle assembly of FIG. 1 according to example embodiments of the present subject matter.

The bottom surface 134 of the griddle 130 may be supported by grate 106 when positioned on gas cooktop 100. For example, bottom surface 134 of the griddle 130 may be in contact with one or more elongated members 108 of grate 106, such as with a peripheral support surface and an intermediate support surface thereof. In addition, it should be appreciated that grate 106 and/or griddle 130 may define complementary features to facilitate proper positioning and alignment of griddle 130 on gas cooktop 100. In this regard, grate 106 may define engagement features (e.g., such as elongated members 108) and griddle 130 may define complementary features (e.g., such as a geometry of outer side 150 or feet 138 as shown in FIGS. 3 and 4), such that the engagement features and the complementary features are configured to engage when griddle 130 is mounted on grate 106 to secure the position of griddle 130. For example, the edges or perimeter of griddle 130 may have a complementary footprint designed for seating on elongated members 108 of grate 106. In addition, or alternatively, feet 138 may be sized and positioned on bottom surface 134 of griddle 130 to securely engage elongated members 108 when griddle 130 is properly positioned on grate 106. Grate 106 and griddle 130 may further define one or more protrusions and complementary detents, complementary ribs and grooves, etc.

In some embodiments, gas cooktop 100 may be configured for closed-loop cooking. For example, controller 124 may be operable to receive a set temperature (such as from a user input of the gas cooktop 100 or wirelessly from a remote device such as a smartphone) and compare the set temperature to temperature measurements from one or more temperature sensors, such as a temperature sensor associated with a cooking utensil (such as griddle 130), to each gas burner 110, 112. Controller 124 may be further programmed to automatically adjust each burner, such as a fuel flow rate to each burner, based on the comparison of the corresponding temperature measurement to the set temperature.

Accordingly, gas cooktop 100 or griddle assembly 128 may include a removably embedded temperature sensor 140 to provide temperature feedback to facilitate such a closed loop cooking process. For example, according to the illustrated embodiment, temperature sensor 140 may generally include a sensor housing 142 and a temperature probe 144 extending therefrom for receipt within griddle 130, as described in more detail below. In general, sensor housing 142 may contain operating electronics and a wireless communication module, e.g., for communicating with controller 124 of gas cooktop 100. For example, the sensor housing 142 and temperature probe 144 may be formed as a single, hermetically sealed package.

As used herein, "temperature sensor" or the equivalent is intended to refer to any suitable type of temperature measuring system or device positioned at any suitable location for measuring the desired temperature. Thus, for example, temperature sensor 140 may each be any suitable type of temperature sensor, such as a thermistor, a thermocouple, a resistance temperature detector, a semiconductor-based integrated circuit temperature sensor, etc. In addition, temperature sensor 140 may be positioned at any suitable location and may output a signal, such as a voltage, to a controller that is proportional to and/or indicative of the temperature being measured. Although exemplary positioning of temperature sensors is described herein, it should be appreciated that gas cooktop may include any other suitable number, type, and position of temperature sensors according to alternative embodiments.

As shown, griddle 130 may be configured to removably and securely receive temperature sensor 140. For example, as illustrated in the figures, griddle 130 may define an outer side 150, e.g., an outer perimeter of griddle 130 within a horizontal plane (e.g., defined by the lateral direction L and the transverse direction T). Temperature sensor 140 may be slidably received within griddle 130 through outer side 150. More specifically, for example, griddle 130 may define a probe receptacle 152 within outer side 150 that is generally configured for receiving sensor housing 142. Although temperature sensor 140 is described herein as being positioned within a predefined probe receptacle 152, it should be appreciated that temperature sensor 140 may be mountable to any suitable location on griddle 130 according to alternative embodiments.

Figure 2:
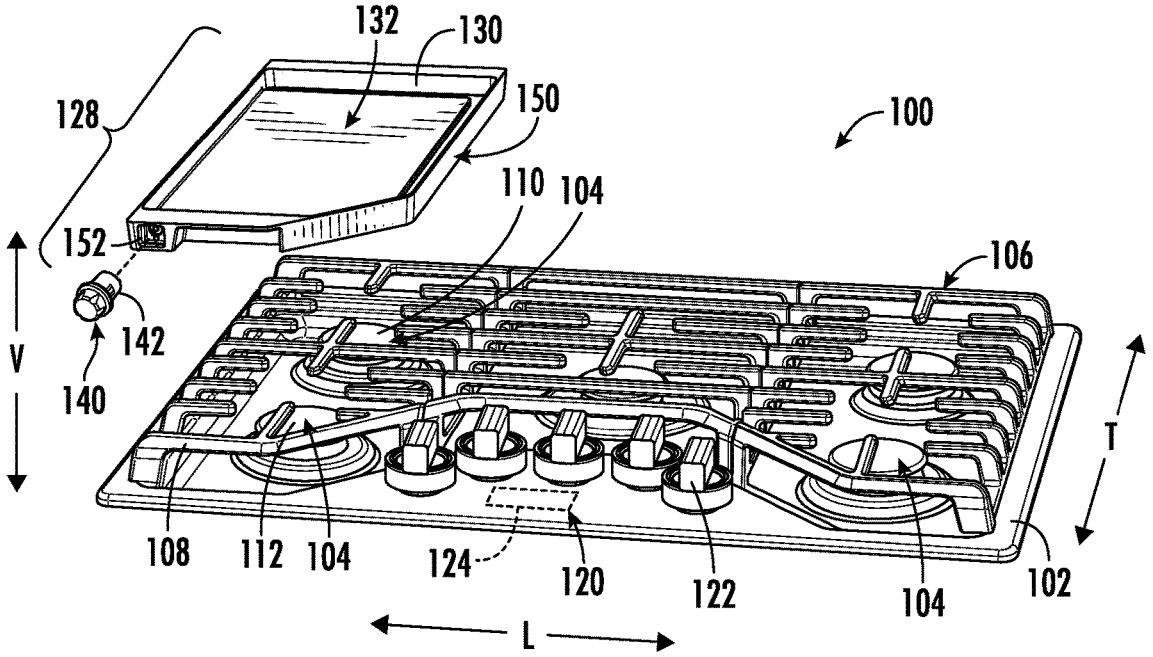
FIG. 2 illustrates the exemplary griddle assembly of FIG. 1 separated from the exemplary gas cooktop of FIG. 1 according to example embodiments of the present subject matter.

It should be appreciated that probe receptacle 152 may be positioned at any suitable location on griddle 130. According to the example illustrated embodiments, probe receptacle is defined on a front side (e.g., forward along the transverse direction) of outer side 150, e.g., to facilitate ease of manipulation by a consumer. In addition, probe receptacle 152 may be defined on a front, corner of griddle 130 (e.g., on a front, left corner as shown in FIG. 2) or at a center of griddle 130 along the lateral direction. In this manner, temperature sensor 140 may be maintained at a suitable distance from second gas burner 112, thereby lowering its operating temperature and extending its operating lifetime.

Referring still generally to FIGS. 1 through 8, griddle assembly 128 will be described in more detail with a particular focus on the structure for facilitating removable installation of temperature sensor 140 within probe receptacle 152 of griddle 130. Specifically, as described in more detail below, aspects of the present subject matter are directed to facilitating the secure attachment and proper alignment of temperature sensor 140 with minimal thermal contact for improved performance during high temperature operation of gas cooktop 100. In addition, the attachment features described herein may effortlessly engage a trigger mechanism that facilitates communication between controller 124 and temperature sensor 140. Aspects of the present subject matter may further facilitate quick and easy removal of temperature sensor 140, e.g., by simple rotation as will be described in more detail below. Although exemplary attachment features are described below, it should be appreciated that variations and modifications may be made while remaining within the scope of the present subject matter.

As shown for example in FIG. 3, griddle assembly 128 may generally include a magnet assembly for facilitating removable engagement between temperature sensor 140 and griddle 130. More specifically, as illustrated, griddle assembly 128 may include a griddle magnet 160 that is positioned within probe receptacle 152. In addition, temperature sensor 140 may include a probe magnet 162 positioned on sensor housing 142. In this manner, when temperature sensor 140 is brought into proximity with griddle 130 near probe receptacle 152, the magnetic attraction between griddle magnet 160 and probe magnet 162 may pull temperature sensor 140 into probe receptacle 152 and secure it in the properly aligned and installed position.

Figure 5:
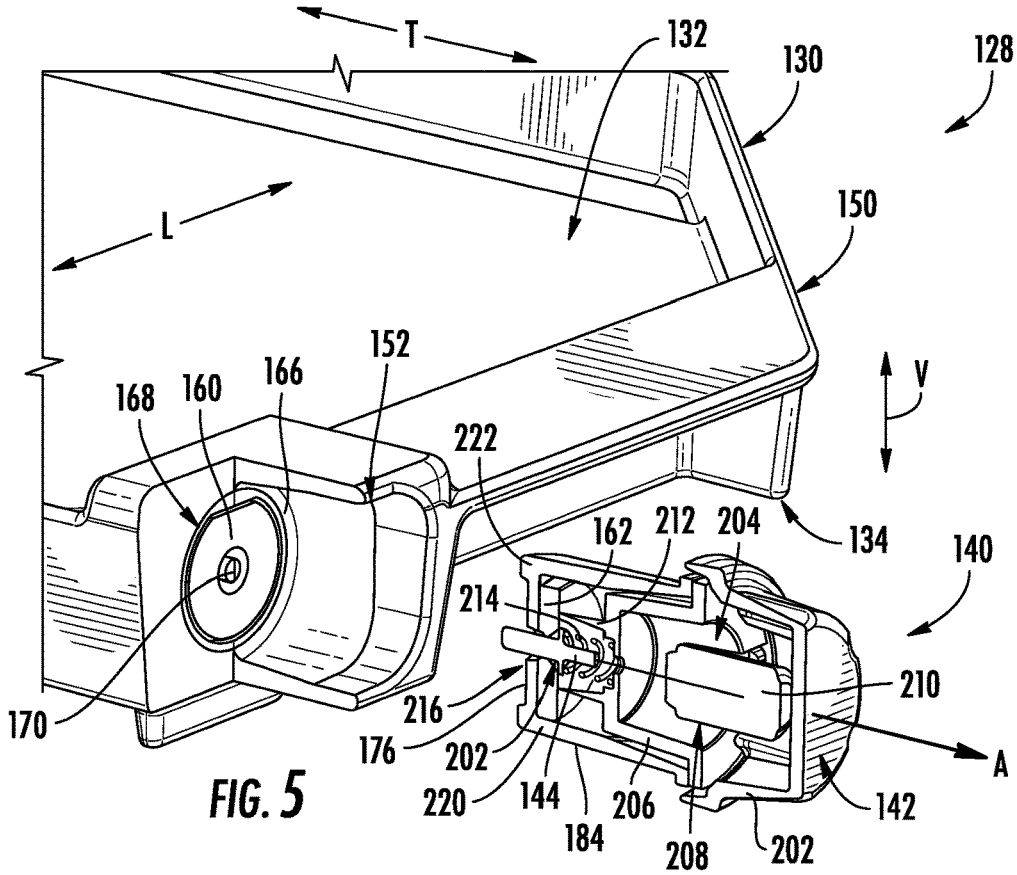
FIG. 5 provides a partial perspective view of the exemplary temperature sensor of FIG. 3 before being installed in the exemplary gas cooktop of FIG. 1 according to example embodiments of the present subject matter.
Figure 6:
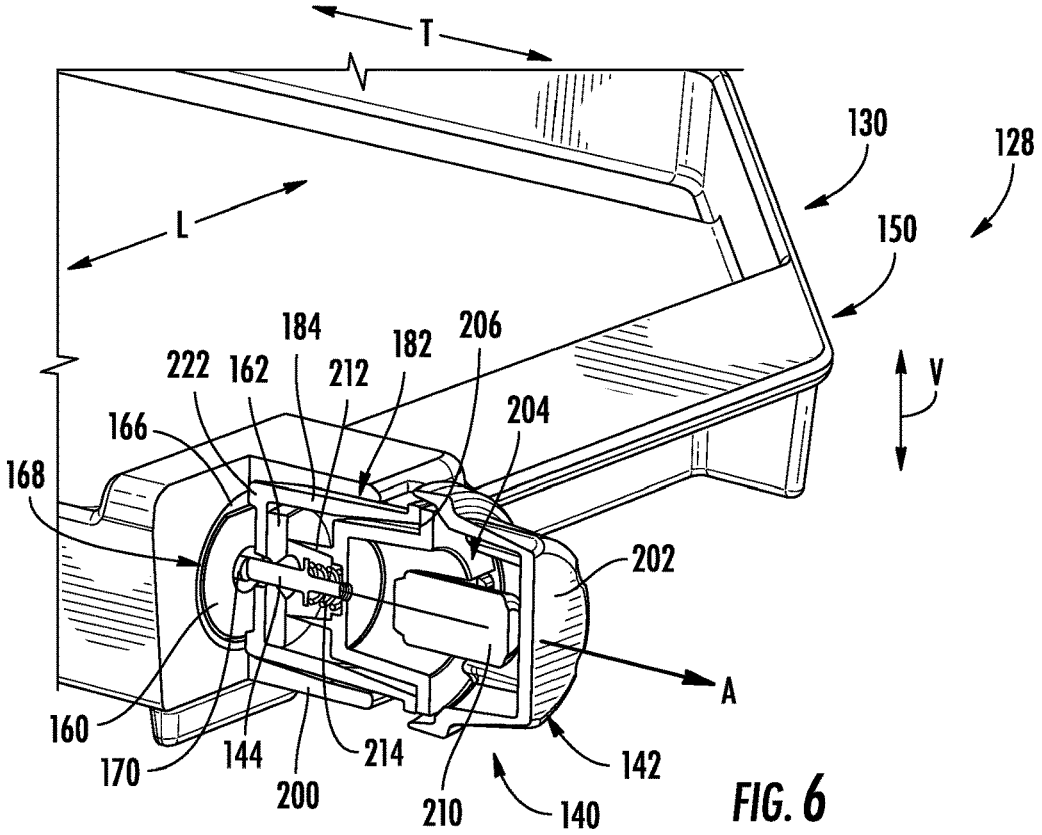
FIG. 6 provides a partial perspective view of the exemplary temperature sensor of FIG. 3 after being installed in the exemplary gas cooktop of FIG. 1 according to example embodiments of the present subject matter.
Figure 7:
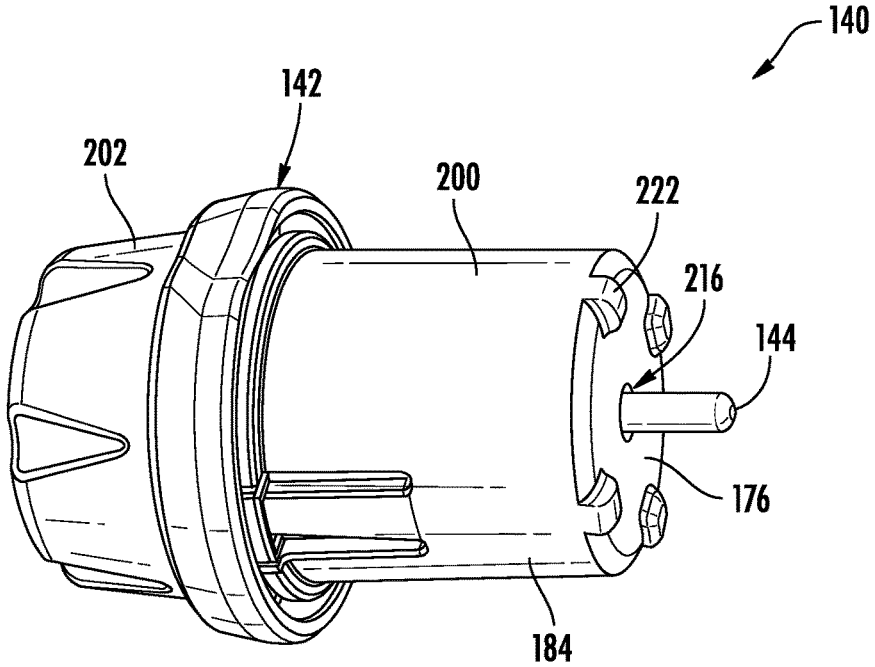
FIG. 7 provides a perspective view of the exemplary temperature sensor of FIG. 3 according to example embodiments of the present subject matter.
Figure 8:
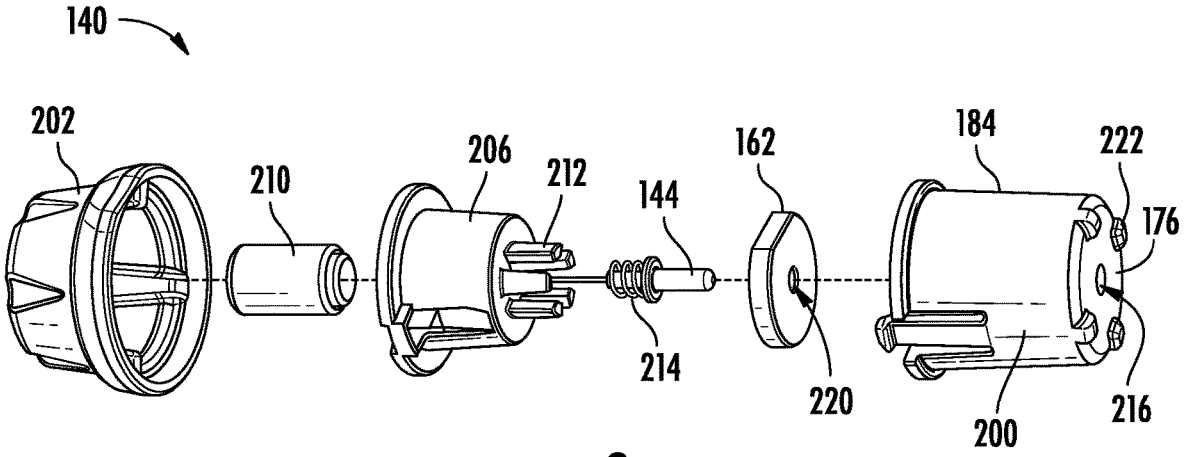
FIG. 8 provides an exploded perspective view of the exemplary temperature sensor of FIG. 3 according to example embodiments of the present subject matter.

More specifically, as shown in FIGS. 3 through 6, temperature sensor 140 is illustrated as being installed into probe receptacle 152. More specifically, FIGS. 4 and 5 illustrate temperature sensor 140 as it is positioned close to probe receptacle 152 (e.g., before temperature sensor 140 is in the fully installed position) and FIGS. 3 and 6 illustrate temperature sensor 140 after being fully installed (e.g., after griddle magnet 160 and probe magnet 162 interact to secure temperature sensor 140 within probe receptacle 152). Notably, when temperature sensor 140 is in the position shown in FIGS. 3 and 6, the magnetic attraction between griddle magnet 160 and probe magnet 162 acts to secure temperature sensor 140 within probe receptacle 152.

Griddle 130 may be formed from any material that is suitably rigid and suitable for high temperature cooking operations. In this regard, for example, griddle 130 may be formed from a nonferrous material, such as aluminum alloy. Notably, construction from such a material may reduce the magnetic attraction between probe magnet 162 and griddle 130, e.g., such that a user may easily position temperature sensor 140 for engagement with griddle magnet 160 during the installation process. According to still other embodiments, griddle 130 may be formed from a ferrous material, such as cast iron or stainless steel. Other materials and griddle constructions are possible and within the scope of the present subject matter.

According to the illustrated embodiment, griddle magnet 160 may be recessed within probe receptacle 152 and permanently secured within griddle 130. Similarly, probe magnet 162 may be recessed within or positioned in sensor housing 142 and permanently attached therein. Specifically, a contact wall 166 (e.g., the back wall along the transverse direction T) of probe receptacle 152 may define a griddle recess 168 for receiving griddle magnet 160 such that a surface of griddle magnet 160 sits flush with contact wall 166. For example, according to the illustrated embodiment, griddle magnet 160 is an annular magnet that surrounds a contact pin 170 that defines a center of griddle recess 168. For example, during manufacturing, griddle magnet 160 may be positioned around contact pin 170 which may be stamped or deformed to lock griddle magnet 160 in place within griddle 130.

According to example embodiments, probe magnet 162 may be secured within sensor housing 142 in a manner similar to that described above. In this regard, probe magnet 162 may be secured within a probe recess that is defined within a rear wall 176 of sensor housing 142. During manufacturing, probe magnet 162 may be placed within probe recess and may be overmolded into place or sensor housing 142 may otherwise be formed to lock probe magnet 162 in place. In addition, or alternatively, any other suitable adhesive or manner of attaching a griddle magnet 160 and probe magnet 162 are possible and within the scope of the present subject matter. According to still other example embodiments, probe magnet 162 may be secured entirely within sensor housing 142.

As noted above, griddle magnet 160 and probe magnet 162 may be positioned and configured for ensuring the desired positioning and alignment of temperature sensor 140 in the installed position. For example, griddle magnet 160 may be positioned in contact wall 166 and probe magnet 162 may be positioned in sensor housing 142 such that proper engagement between these magnets aligns sensor housing 142 within probe receptacle 152 such that a gap 182 is defined between sides 184 of sensor housing 144 and the walls of probe receptacle 152. In this manner, undesirable thermal contact between griddle 130 and sensor housing 142 may be minimized, thereby reducing conductive heat transfer to the sensitive electronics within temperature sensor 140.

Referring now specifically to FIGS. 5 through 8, temperature probe 144 will be described in more detail according to example embodiments of the present subject matter. As illustrated, temperature probe 144 is positioned within sensor housing 142 and is movable between an extended position and a retracted position. More specifically, when temperature sensor 140 is in an uninstalled position, temperature probe 144 is in the extended position. However, when temperature sensor 140 is positioned in proximity to probe receptacle 152, griddle magnet 160 and probe magnet 162 may generate a magnetic attractive force that pulls temperature sensor 140 into probe receptacle, thereby securing temperature sensor 140 such that temperature probe 144 engages contact pin 170 and is pushed into the retracted position. In this manner, thermal communication between temperature probe 144 and griddle 130 may be achieved when temperature sensor 140 is installed.

Accordingly, temperature probe 144 may be a plunger switch that physically engages contact pin 170 in the installed position (e.g., as best shown in FIG. 6). When temperature probe 144 is depressed, the operating electronics of temperature sensor 140 may begin communication with controller 124 of gas cooktop 100. It should be appreciated that according to alternative embodiments, temperature probe 144 may generally be any suitable mechanical, electromechanical, or electrical switch capable of detecting when temperature sensor 140 is properly installed.

As shown in FIGS. 5 through 8, sensor housing 142 may generally include a lower housing portion 200 and an upper housing portion 202 that are coupled together to contain the working components and electronics of temperature sensor 140. According to example embodiments, lower housing portion 200 and upper housing portion 202 form hermetically sealed chamber or an internal chamber 204. As shown, an intermediate support 206 may be positioned within internal chamber 204 between lower housing portion 200 and upper housing portion 202. Intermediate support 206 may define a first chamber 208 that contains an electronics assembly 210 of temperature sensor 140. For example, electronics assembly 210 may include a power supply (e.g., a battery), a wireless communication module (e.g., for communicating with controller 124), and other operating electronics of temperature sensor 140.

Intermediate support 206 may further define a sleeve 212 opposite the first chamber 208, e.g., proximate lower housing portion 200. Sleeve 212 may be configured for slidably receiving temperature probe 144. In addition, temperature sensor 140 may include a mechanical spring 214 positioned within sleeve 212 of sensor housing 142 and engaging temperature probe 144 to urge temperature probe 144 toward the extended position. In this manner, temperature probe 144 may protrude from lower housing portion 200 through an aperture 216 in the extended position. When temperature sensor 140 is installed, mechanical spring 214 may be compressed and temperature probe 144 moves to the retracted position while maintaining solid thermal contact with contact pin 170 of griddle 130.

Referring still for example to FIG. 6, temperature probe 144 may be positioned at a center of rear wall 176 of sensor housing 142. In this manner, sensor housing 142 may be rotated within probe receptacle 142. In addition, as illustrated, probe magnet 162 is positioned within lower housing portion 200 for facilitating magnetic attraction with griddle magnet 160. As shown, probe magnet 162 is annular and defines a central opening 220 and temperature probe 144 extends through the central opening 220 and through lower housing portion 200 to the extended position. Sensor housing 142 may further include one or more support feet 222 extending from lower housing portion 200, e.g., to facilitate proper seating of temperature housing 140 within probe receptacle 152.

Notably, the configuration of griddle magnet 160 and probe magnet 162 may facilitate the triggering of temperature probe 144. In this regard, according to the illustrated embodiment, probe magnet 162 may be annular and concentrically positioned about temperature probe 144. In this manner, the magnetic force between griddle magnet 160 and probe magnet 162 may ensure firm engagement between contact pin 170 and temperature probe 144.

According to still other embodiments, griddle magnet 160 and probe magnet 162 may be polymagnets that are configured to position and align sensor housing 142 within probe receptacle 152 in the installed position. In this regard, "polymagnets," which are sometimes referred to as programmed magnets, are magnetic structures that incorporate magnetic patterns with alternating polarity complementary to other polymagnets in a particular orientation. In this regard, griddle magnet 160 and probe magnet 162 may generate localized magnetic fields that are complementary to each other and facilitate proper relative alignment and orientation.

For example, according to an example embodiment of the present subject matter, griddle magnet 160 and probe magnet 162 are in a first orientation in the installed position. In this regard, a user may position temperature sensor 140 near probe receptacle 152 and the polymagnet pair of griddle magnet 160 and probe magnet 162 may rotate temperature sensor 140 to the first orientation and pull it into the installed position (e.g., where temperature probe 144 is urged into contact with contact pin 170 and toward the retracted position). Moreover, temperature sensor 140 may be rotatable about an axis of rotation A from the first orientation to a second orientation. Notably, in the second orientation, the polymagnet pair of griddle magnet 160 and probe magnet 162 may generate a repulsive force, contrary to the attractive force generated in the first orientation. Notably, this may facilitate easy removable of temperature sensor 140, where instead of pulling temperature sensor 140 directly outward along the axial direction A (requiring a relatively large force), a user may simply rotate temperature sensor 140 to the second orientation such that griddle magnet 160 and probe magnet 162 generate a repulsive force for easier removal of temperature sensor 140.

It should be appreciated that the polymagnet pair of griddle magnet 160 and probe magnet 162 may be designed such that temperature sensor 140 may be rotated any suitable angular distance to facilitate removal. For example, an angle of rotation may be defined between the first orientation and the second orientation of temperature sensor 140 in probe receptacle 152. According to example embodiments, the angle of rotation may be between about 150 and 165°, between about 30° and 150°, between about 450 and 135°, between about 600 and 120°, or about 90°.

Temperature sensor 140 may generally be formed from any suitable material capable of withstanding the high temperature associated with a cooking process. For example, sensor housing 142 may generally be formed from any suitable high-temperature thermoset material. According to still other embodiments, it should be appreciated that sensor housing 142 may be surrounded by any suitable insulating sleeve or coating. For example, temperature sensor 140 may include a ceramic contact insert that defines rear wall 176 of sensor housing 142. In this manner, the physical contact between sensor housing 142 and griddle 130 may be through a relatively insulative and durable contact piece.

Notably, whether temperature sensor 140 is positioned at a center of griddle 130 or at a front corner of griddle 130, controller 124 may be in operative communication with temperature sensor 140 and may be used to obtain accurate temperature measurements of griddle 130. In this regard, for example, controller 124 may be configured to obtain a temperature measurement at the corner of griddle 130 using the temperature probe 144 and determine a center griddle temperature of the griddle using the temperature measurement and a transfer function or mathematical relationship.

More specifically, controller may be in operative communication with temperature sensor 140 and may begin communications with temperature sensor 140 when it is determined that temperature probe 144 is in the retracted position. In this manner, controller 124 may facilitate a closed loop cooking process when temperature sensor 140 is properly installed and temperature probe 144 is retracted (e.g., indicating good thermal contact with contact pin 170). In this regard, the closed loop cooking process may include obtaining griddle temperature measurements from temperature sensor 140 and adjusting the operation of first gas burner 110 and second gas burner 112 to ensure that the griddle temperature is urged toward a target cooking temperature.

Figure 9:
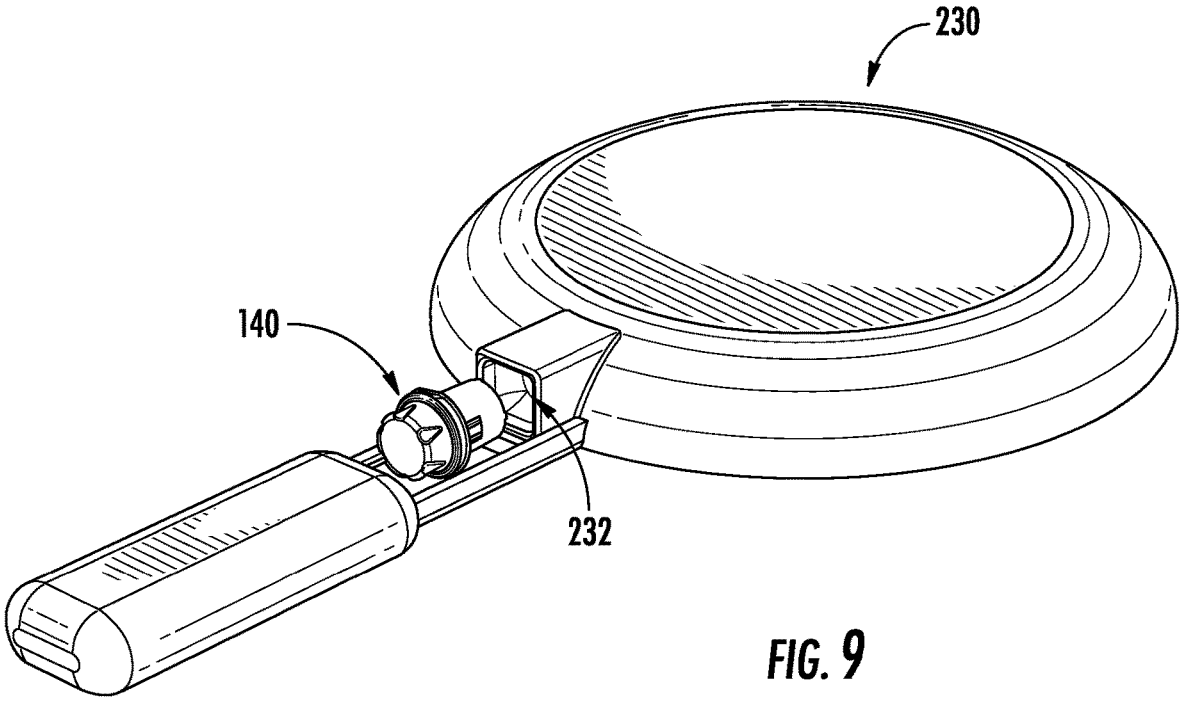
FIG. 9 provides a bottom, perspective view of a temperature sensor prior to being installed in a cooking utensil according to example embodiments of the present subject matter.
Figure 10:
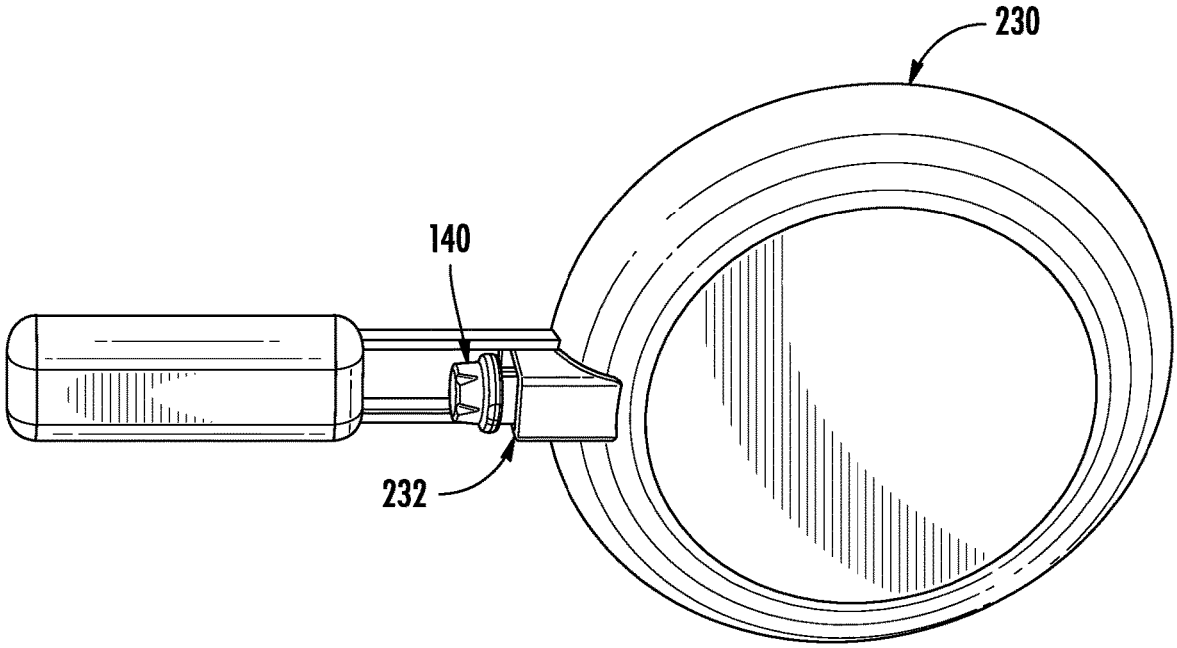
FIG. 10 provides a bottom, perspective view of the exemplary temperature sensor of FIG. 9 installed in the exemplary cooking utensil of FIG. 9 according to example embodiments of the present subject matter.

Although the description above refers to the use of temperature sensor 140 with griddle 130 of griddle assembly 128, it should be appreciated that aspects of the present subject matter may be equally applicable to other cookware or cooking utensils. For example, referring now briefly to FIGS. 9 and 10, temperature sensor 140 is illustrated as being used with a pan 230. More specifically, FIG. 9 illustrates temperature sensor 140 prior to being installed into a probe receptacle 232 of pan 230 and FIG. 10 illustrates temperature sensor 140 after installation. Other cooking utensils may be used and the position of the probe receptacle may vary while remaining within the scope of the present subject matter.

As explained herein, aspects of the present subject matter are generally directed to a magnetic removable wireless temperature sensor that has a torque release function. In specific, the wireless removable temperature sensor may have a spring-loaded temperature probe intended for use with compatible griddle or cookware. This ensures the temperature is measured at the same point regardless of rotational position and avoids the need to align or insert sheaths into long holes. The temperature probe measures the temperature of the inner surface(s) of the receptacle to infer a cookware center temperature.

The removable wireless temperature sensor may further include a magnet embedded within. The magnet may be positioned concentric about the axis of the temperature sensor. A cookware or cooking utensil, e.g., a griddle, may include a probe receptacle configured to receive the temperature sensor. Another magnet may be contained within the griddle receptacle. The magnets may be programmed polymagnets that provide a torque function. The torque function magnets are attracted axially in some relative rotatable orientations and repel at other rotations. Thus, when the temperature sensor is inserted or positioned proximate the probe receptacle, the temperature sensor will snap into the probe receptacle while also aligning to a predetermined orientation. To remove, the user simply rotates the temperature sensor (90 degrees in this example) and the magnets may propel the temperature sensor out of the probe receptacle.

Different cooking utensils may have different offsets between the temperature measured at the probe receptacle and the center griddle temperatures. Thus, a single temperature sensor may be used for various cooking utensils by providing in it the ability to reprogram it or change the settings depending on what cookware it is paired with so it may provide the proper respective offset for that cookware to the control. The spring-loaded temperature probe may also serve when depressed to provide confirmation to the control that the temperature sensor is physically paired to the cookware, as well as other functions such as a power-on or wake-up feature.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas cooktop defining a vertical direction, a lateral direction, and a transverse direction, the gas cooktop comprising:

a gas burner for selectively generating a flow of heated air;

a cooking utensil defining a probe receptacle and a contact pin within the probe receptacle;

a utensil magnet positioned within the probe receptacle; and a temperature sensor configured for receipt within the probe receptacle, the temperature sensor comprising:

a sensor housing;

a temperature probe positioned within the sensor housing and being movable between an extended position and a retracted position; and a probe magnet mounted to the sensor housing, the probe magnet engaging and utensil magnet to secure the temperature sensor such that the temperature probe engages the contact pin and is pushed into the retracted position.

2. The gas cooktop of claim 1, wherein the temperature sensor further comprises:

a mechanical spring positioned within the sensor housing and engaging the temperature probe to urge the temperature probe toward the extended position.

3. The gas cooktop of claim 1, wherein the temperature probe is positioned at a center of a rear wall of the sensor housing.

4. The gas cooktop of claim 1, wherein the probe magnet is annular and defines a central opening, the temperature probe extending through the central opening.

5. The gas cooktop of claim 1, wherein the cooking utensil defines a magnet recess in the probe receptacle, and wherein the utensil magnet is received within the magnet recess.

6. The gas cooktop of claim 5, wherein the utensil magnet is annular and surrounds the contact pin for engaging the temperature probe when the temperature sensor is in an installed position.

7. The gas cooktop of claim 1, wherein the utensil magnet and the probe magnet are polymagnets configured to position and align the sensor housing within the probe receptacle in an installed position.

8. The gas cooktop of claim 7, wherein the utensil magnet and the probe magnet are in a first orientation in the installed position, and wherein the temperature sensor is rotatable about an axis of rotation from the first orientation to a second orientation where the utensil magnet and the probe magnet generate a repulsive force to facilitate removal of the temperature sensor from the probe receptacle.

9. The gas cooktop of claim 8, wherein an angle of rotation between the first orientation and the second orientation is between about 60 degrees and 120 degrees.

10. The gas cooktop of claim 1, wherein the utensil magnet and the probe magnet align the temperature sensor such that a gap is defined between sides of the sensor housing and sidewalls of the probe receptacle.

11. The gas cooktop of claim 1, wherein the cooking utensil is a griddle, a skillet, a pot, or a pan.

12. The gas cooktop of claim 1, further comprising a controller in operative communication with the temperature sensor, the controller being configured to:

determine that the temperature probe is in the retracted position; and initiate a closed loop cooking process by regulating operation of the gas burner based at least in part on temperature measurements obtained by the temperature probe.

13. The gas cooktop of claim 1, wherein the cooking utensil is formed from a nonferrous material.

14. The gas cooktop of claim 1, wherein the cooking utensil is formed from aluminum alloy.

15. A cooking utensil assembly for a gas cooktop, the gas cooktop comprising a gas burner for selectively generating a flow of heated air, the cooking utensil assembly comprising:

a cooking utensil defining a probe receptacle and a contact pin within the probe receptacle;

a utensil magnet positioned within the probe receptacle; and a temperature sensor configured for receipt within the probe receptacle, the temperature sensor comprising:

a sensor housing;

a temperature probe positioned within the sensor housing and being movable between an extended position and a retracted position; and a probe magnet mounted to the sensor housing, the probe magnet engaging and utensil magnet to secure the temperature sensor such that the temperature probe engages the contact pin and is pushed into the retracted position.

16. The cooking utensil assembly of claim 15, wherein the temperature sensor further comprises:

a mechanical spring positioned within the sensor housing and engaging the temperature probe to urge the temperature probe toward the extended position.

17. The cooking utensil assembly of claim 15, wherein the cooking utensil defines a magnet recess in the probe receptacle, wherein the utensil magnet is received within the magnet recess, and wherein the utensil magnet is annular and surrounds the contact pin for engaging the temperature probe when the temperature sensor is in an installed position.

18. The cooking utensil assembly of claim 15, wherein the utensil magnet and the probe magnet are polymagnets configured to position and align the sensor housing within the probe receptacle in an installed position.

19. The cooking utensil assembly of claim 18, wherein the utensil magnet and the probe magnet are in a first orientation in the installed position, and wherein the temperature sensor is rotatable about an axis of rotation from the first orientation to a second orientation where the utensil magnet and the probe magnet generate a repulsive force to facilitate removal of the temperature sensor from the probe receptacle.

20. The cooking utensil assembly of claim 15, wherein the utensil magnet and the probe magnet align the temperature sensor such that a gap is defined between sides of the sensor housing and sidewalls of the probe receptacle.

* * * * *